US006390161B1

(12) United States Patent
Freitag et al.

(10) Patent No.: US 6,390,161 B1
(45) Date of Patent: May 21, 2002

(54) PROCESS AND DEVICE FOR CUTTING WOOD

(76) Inventors: Joachim Freitag, Novalisstrassse 17, D-07747; Andreas Freitag, Anna-Siemsen-Strasse 15, D-07745, both of Jena (DE)

( * ) Notice: Subject to any disclaimer, the term of this patent is extended or adjusted under 35 U.S.C. 154(b) by 0 days.

(21) Appl. No.: 09/397,813

(22) Filed: Sep. 17, 1999

(30) Foreign Application Priority Data

Sep. 21, 1998 (DE) ..... 198 43 612

(51) Int. Cl.[7] ..... B27L 11/00
(52) U.S. Cl. ..... 144/174; 144/180; 144/162.1
(58) Field of Search ..... 144/174, 172, 144/180, 162.1; 241/92

(56) References Cited

U.S. PATENT DOCUMENTS

| | | | | |
|---|---|---|---|---|
| 2,620,138 A | | 12/1952 | Vazieux | |
| 3,661,192 A | * | 5/1972 | Nicholson et al. | 144/176 |
| 4,085,494 A | * | 4/1978 | Sybertz et al. | 144/172 |
| 4,313,480 A | * | 2/1982 | Pontelin | 144/193 |
| 4,865,094 A | * | 9/1989 | Stroud et al. | 144/176 |
| 4,874,024 A | * | 10/1989 | Arasmith | 144/174 |
| 5,647,417 A | * | 7/1997 | Schaefer et al. | 144/172 |
| 5,692,549 A | * | 12/1997 | Eggers | 144/247 |
| 5,762,122 A | * | 6/1998 | Rice, Sr. | 144/176 |
| 5,964,264 A | * | 10/1999 | Kokko | 144/172 |

FOREIGN PATENT DOCUMENTS

| | | |
|---|---|---|
| DE | 894765 | 1/1953 |
| DE | 1203446 | 12/1957 |
| DE | 2539583 | 4/1976 |
| DE | 2947199 | 6/1981 |
| DE | 3245373 | 6/1984 |
| DE | 35 05 072 C2 | 8/1986 |
| DE | 43 35 348 C1 | 6/1994 |
| DE | 19500960 | 1/1995 |

* cited by examiner

*Primary Examiner*—M. Rachuba
*Assistant Examiner*—Kim Ngoc Tran
(74) *Attorney, Agent, or Firm*—Reed Smith LLP

(57) ABSTRACT

A process is disclosed for cutting logs to form large-surface wood chips, in which, on the one hand, a rotating knife ring provided with cutting knives which are oriented parallel to its axis of rotation and, on the other hand, a quantity of logs which are likewise oriented parallel to the axis of rotation of the knife ring are moved toward one another and the logs are cut. A device for carrying out this process is also disclosed. In a device of the type mentioned above, the movement of the knife ring directed to the logs and/or the movement of the logs directed to the knife ring is carried out on a curved path at least during the cutting process. In this way, individual chip sectors are "compressed", while others are "expanded" in such a way that there is a greater proportion of chips whose quality lies within the predetermined tolerance.

2 Claims, 5 Drawing Sheets

PROCESS AND DEVICE FOR CUTTING WOOD

BACKGROUND OF THE INVENTION a) Field of the Invention

The invention is directed to a process for cutting rough timber or logs to form large-surface wood chips, in which, on the one hand, a rotating knife ring provided with cutting knives which are oriented parallel to its axis of rotation and, on the other hand, a quantity of logs which are likewise oriented parallel to the axis of rotation of the knife ring are moved toward one another and the logs are cut. The invention is further directed to a device for carrying out this process.

b) Description of the Related Art

Processes and devices for cutting wood have been known in the art for a long time. With the development of wood materials such as chipboard, fiberboard, beams and molded articles of particle board, etc., this type of technology has gained in importance and is constantly being perfected.

One of the earliest wood materials developed is oriented strand board (OSB), which is a further development of conventional chipboard. By the expression "strand" is meant in this case large-area wood chips with a preferred geometry, for example, 100 mm×14 mm×0.5 mm, which are glued together in flat cross-laminated layers to form OSB. The panels formed in this way are distinguished from conventional chipboard by substantially increased strength. Moreover, because of the layer orientation of the wood chips, they have a significantly lower proportion of glue and a more favorable ratio of wood to glue components which economizes on glue.

However, the development of OSB has also led to stricter requirements for the quality of wood chips because the advantages mentioned above can only be achieved by maintaining the chip geometry, especially the chip thickness.

Accordingly, one of the primary requirements of corresponding processes and devices for wood cutting is to supply chips of a defined quality. This effort with respect to chip quality has led in recent times to the development of cutting machines for logs and remainder wood, e.g., for round logs that have not been cut to length, in which the cutting is carried out by a rotating knife ring. This knife ring essentially has the geometry of a hollow cylinder, wherein cutting knives which are oriented parallel to the axis of rotation are arranged along the inner circumference of the knife ring so as to be distributed in a radially symmetric manner.

A bundle of logs which are oriented parallel to the axis of rotation are pushed into the knife ring gradually in a cyclic manner, that is, by lengths corresponding to the dimensioning of the knives in the axial direction; in doing so, the knives do not initially engage with the logs. After the logs are pushed in, they are clamped by a holding system and the rotating knife ring is then moved in the radial direction toward the portion of the logs projecting into its interior space, the cutting chamber, as it is called, so that the knives consequently come into contact with the logs and the cutting is carried out, wherein the required chip quality is achieved through the peeling effect brought about by the rotating knives oriented parallel to the longitudinal direction of the logs.

Of course, the forward feed speed, knife projection, pitch of the knife ring and quantity of knives at the circumference, cutting speed, radius of the orbit of the cutters, etc. play a substantial role in the chip forming process as regards chip quality. Extensive research has already been carried out in this regard; the findings are known and are already in use. However, another essential criterion in the production of strands has not yet been adequately met, namely, the amount of chips of like quality, especially of like chip thickness, that can be achieved in one revolution of the knife ring.

It will be seen from a consideration of the movement curves of the cutting knives that during the cutting process every cutter describes a path which extends in a spiral and corresponds to a helical line with a pitch that depends on the forward feed direction and on the forward feed speed.

In principle, horizontal cutting and vertical cutting are known with respect to the forward feed movement, wherein "horizontal" and "vertical" refer to the forward feed direction of the knife ring. For example, Patent DE 35 05 077 C2 shows a machine for horizontal cutting in which the wood bundle is deposited on a horizontally arranged sliding wall and is pushed into the interior of the knife ring by means of a feed pusher so as to slide along this sliding wall and is held in this position by clamping elements. The forward feed movement of the rotating knife ring is then carried out in the horizontal direction, for example, from left to right, wherein the cutting of the wood bundle is carried out. The depth of the cutting chamber is predetermined by the axial length of the individual knives.

The principal difference in vertically cutting machines compared with horizontal cutters essentially consists in the vertically directed forward feed movement of the knife ring. In this case, a bundle of logs is advanced into the interior of the knife ring initially with the help of a feed device, again in this case by a distance corresponding to the axial length of the knives. The rotating knife ring is then set in motion in a vertical forward feed movement, wherein the cutting is carried out. Patent DE 43 35 348 C1 discloses a long-timber or long-wood cutter in which the forward feed movement is directed vertically, specifically upward, toward the wood bundle. Similarly, the construction of cutting devices with a vertical downward movement of the knife ring is also conceivable.

The straight-line forward feed movement is characteristic of both arrangements described above. The cutting process taking place in this connection will be briefly described in the following. In this connection, FIG. 1 shows a schematic diagram of a knife ring with $m_G$=36 knives. In theory, of these knives, only $m_\epsilon$=18 knives which are arranged on the half-circle in the forward feed direction can be engaged. Assuming a forward feed movement that is directed vertically upward, as is shown in FIG. 1, different forward feed paths result for the individual cutters depending on their instantaneous position at the circumference of the knife ring, which leads to different chip thicknesses.

A cutter A and the cutter B trailing behind cutter A are shown in FIG. 1 for different phase angles a during the rotation of the knife ring. It will be seen that the largest chip thickness results at $d_3$ and the smallest chip thickness results at $d_1$. The occurring chip thicknesses therefore depend on the respective position of a cutting knife at the circumference of the knife ring at which engagement is carried out.

In order to establish a scale for evaluating the quality of the delivered chips in relation to the positions of the cutting knives, the circumference of the knife ring is divided into sectors which deliver chips having a thickness within permissible tolerance limits.

In FIG. 2, the knife ring for a vertical cutter with upward cutting is divided into individual phase sectors, wherein the sectors extend in the forward feed direction and the division is determined by the quantity of knives. Since, theoretically only $m_e$=18 knives of the total of $m_G$=36 knives can be engaged and these 18 knives are distributed symmetrically with respect to the axis of rotation, a quantity of nine sectors $S_1$ to $S_9$ results. It is assumed that chips with a thickness within a range of permissible tolerances occur within each sector.

Therefore, it can be concluded that chips with a sufficiently consistent or unitary thickness are obtained only when the wood bundle is kept only in one of the sectors, or, in some cases, in two or three neighboring sectors, for example, sectors $S_1$ and $S_2$, during the cutting process. However, it is likewise clear that the economy of a cutting device, especially with respect to the production of OSB, is essentially dependent on how many chips of unitary thickness are produced in one revolution of the knife ring. In the graph shown in FIG. 3, the areas shown by each sector $S_1$ to $S_6$ represent a measurement for the amount of chips occurring in these sectors. It will be seen that only the chips from sectors $S_1$ and $S_2$ and possibly also from sector $S_3$, depending on the strictness of the quality requirement, can be used. This also reveals the disadvantage of the prior art, namely, that the amount of chips of sufficient quality which can be generated per unit of time is very small.

OBJECT AND SUMMARY OF THE INVENTION

On this basis, it is the object of the invention to further develop a process of the type described above for cutting logs in such a way that a larger quantity of chips meeting the above-described quality requirements can be produced in every revolution of the knife wheel.

This object is met according to the invention in that the movement of the knife ring directed to the logs and/or the movement of the logs directed to the knife ring are/is carried out on a curved path at least during the cutting process.

Because of the relative movement between the knife ring and the bundle of logs to be cut, which relative movement extends along a curved path, individual chip sectors are "compressed", while others are "expanded". The areas along the chip sectors (see FIG. 3) are therefore no longer distributed symmetrically with respect to the axis of rotation, but rather are displaced in an asymmetric manner in such a way that there is a greater proportion of chips whose quality lies within the predetermined tolerance.

A particularly preferred development of the invention results for a process variant in which the knife ring is moved on a circular path, while the logs are held relatively at rest with respect to the knife ring.

In this case, it can be provided in an advantageous manner that the logs are held between side walls which have a circular arc-shaped curvature like the movement of the knife ring, wherein the movement path of the knife ring and the curvatures of the side walls have the same center point.

In a particularly preferred embodiment of the invention, the logs are initially held by one end and their opposite, free end is introduced into a rotating knife ring which is outfitted at its inner circumference with axially parallel cutting knives and the knife ring is then moved vertical to its axis of rotation on a circular path, wherein the cutting is carried out in the interior of the knife ring.

Another object met by the invention consists in that a device for cutting logs with a rotating knife ring outfitted at its inner circumference with cutting knives oriented parallel to its axis of rotation, with a feeding and holding system for logs by which the logs are held by one end and introduced into the knife ring by the opposite, free end, and with a forward feed device for generating a movement of the rotating knife ring directed to the free ends of the logs, is further developed in such a way that the amounts of chips with a chip thickness lying within tolerances which are produced with every revolution of the knife wheel are greater than in the prior art.

This object is met according to the invention in that the forward feed device has a part which is swivelable on a circular path, wherein the rotating knife ring is arranged on this part, wherein the swiveling axis associated with the part and the axis of rotation of the knife ring are oriented parallel to one another.

The driving motor for the knife ring and the transmission elements for transmitting the rotating movement of the driving motor to the knife ring can also be arranged on the swivelable part, e.g., a rocker, on which the knife ring is arranged. This results in advantageous design aspects because the driving motor can be used at the same time as a counterweight with respect to the mass of the knife ring and can be mounted on the opposite side of the swiveling axis. In order to generate the swiveling movement, a hydraulic drive can be provided, for example, a hydraulic cylinder, which is connected with the swiveling lever in such a way that the knife ring is displaced relative to the wood bundle to be cut when the piston rod travels out.

Further, it is advantageous when the logs are held between two side walls which have a circular arc-shaped curvature, wherein the centers of the curvatures of the two side walls lie in the swiveling axis of the knife ring and the radius of curvature of a first side wall is less than the swiveling radius of the knife ring and the radius of curvature of the second side wall is greater than the swiveling radius of the knife ring. In this way, the axis of rotation of the knife ring moves between the side walls at a constant distance from the two side walls during the forward feed movement.

Further, the radii of curvature can be dimensioned in such a way that the distances between the circular path of the axis of rotation of the knife ring and the inner and outer side walls are not equal, but rather, e.g., the distance between the axis of rotation and the outer side wall, i.e., the side wall with the larger radius of curvature, is greater than the distance between the axis of rotation and the inner side wall, i.e., the side wall with the smaller radius of curvature. This advantageously results in a displacement of the chip sectors and accordingly in a further increase in the quantity of chips having sufficient quality.

In this connection, a distinctive feature within the framework of the invention consists in that the side walls are constructed in such a way that they project into the knife ring by portions corresponding approximately to the axial dimension of the knives and are arranged so as to be stationary with respect to the knife ring. During operation of the device according to the invention which is constructed according to this variant, the side walls follow the movement of the knife ring, wherein they move relative to the logs. This results particularly in the advantage that the logs which become increasingly shorter as a result of the cyclic forward feed movement are held more securely within the cutting chamber even in the case of short lengths.

Further, the invention can be arranged in such a way that the knife ring is not supported on a rocker or a swivel lever, but rather on a guide carriage which is arranged so as to be displaceable on a curved path which is preferably likewise a circular path. In this case also, the driving motor for the knife ring can likewise be mounted on the guide carriage and, in this connection, it is also advantageous for generating the forward feed movement to use a hydraulic cylinder which is stationary with respect to the frame on the one hand and is connected with the guide carriage on the other hand and which moves the guide carriage when the piston rod moves out and accordingly triggers the forward feed movement.

It can further be provided in an analogous construction variant that the knife ring is connected with a gear unit element of a four-part coupling gear unit, for example, a sliding crank gear, and is accordingly movable on a circular path. In this case, it is also advantageous to connect the coupling gear with a hydraulic drive in order to trigger the movement of the coupling gear and the forward feed movement of the knife ring.

A very advantageous arrangement of the invention can be achieved when the radius of curvature of the forward feed movement lies within a range of 1800 mm to 2500 mm.

Of course, arrangements in which a forward feed movement of the knife ring is carried out on a nonuniformly curved path, for example, a parabola, are also conceivable and lie within the scope of the described invention.

The invention will be explained more fully in the following with reference to an embodiment example.

DESCRIPTION OF THE PREFERRED EMBODIMENTS

Figure 4:
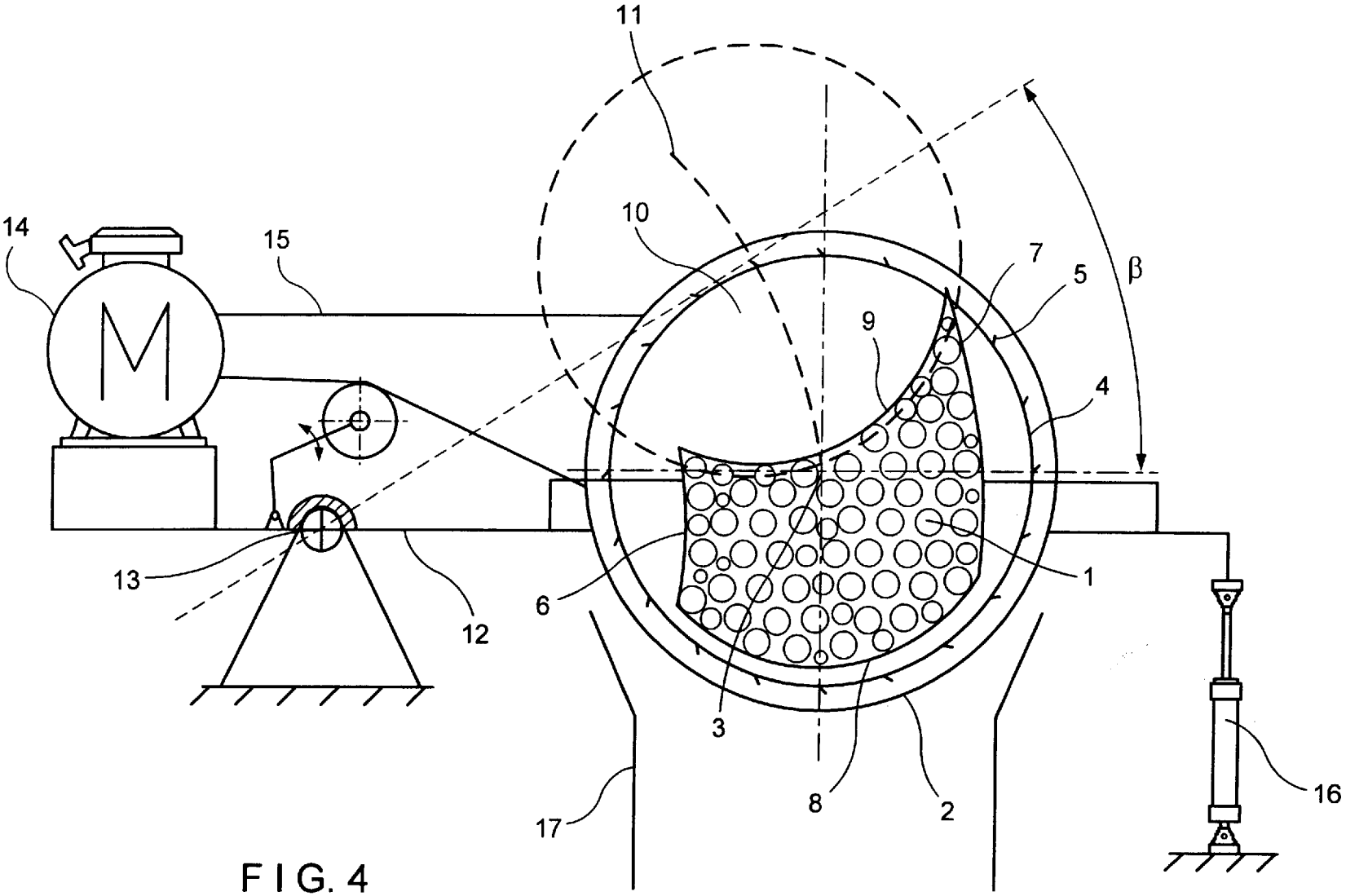
FIG. 4 is a schematic view of an arrangement according to the invention.

FIG. 4 shows a device for cutting logs 1 in which a knife ring 2 is supported so as to be rotatable about an axis of rotation 3. In the view according to FIG. 4, the axis of rotation 3 extends vertical to the drawing plane; the logs 1 are oriented with their longitudinal direction parallel to the axis of rotation 3.

The knife ring 1 has the geometric shape of a hollow cylinder which is outfitted at its inner circumference 4 with cutting knives 5. The cutting knives 5 are distributed in a radially symmetric manner at the inner circumference 4 of the knife ring 2, i.e., they are equidistant from one another with respect to the arc shape. FIG. 4 shows twenty cutting knives 5 by way of example.

The device further comprises a feeding and holding system for the logs 1, wherein substantially a first side wall 6, a second side wall 7, a base surface 8 and a counter-wall 9 are provided for realizing the holding function. The logs 1 are deposited on the base surface 8, specifically in such a way that they are displaceable on the base surface 8 in a sliding manner in their longitudinal direction and in the direction of the axis of rotation 3. The logs 1 which are deposited on the base surface 8 and held towards the sides by the two side walls 6 and 7 are layered one top of each other to form a bundle. The depositing of the logs 1 on the base surface 8 for purposes of charging the device is carried out outside of the knife ring 2.

After charging the device and after the logs are deposited on the base surface 8 between the side walls 6 and 7, the logs 1 are pushed forward (vertical to the drawing plane) into the interior space of the knife ring 2, i.e., into the cutting chamber 10, by means of the feed system which is not shown in the drawing. For this purpose, the logs 1 are pushed into the knife ring 2 by lengths corresponding to the length of the cutting knives 5 in the axial direction.

The cutting process is now initiated in that the knife ring 2 is set in rotation about the axis of rotation 3 and is then moved toward the logs 1 which are located in the cutting chamber 10 so as to be relatively at rest relative to the knife ring 2. The cutting process starts when the rotating cutting knives 5 engage with the logs 1 lying closest to the circumference 4. The forward feed forces occurring during this process are received by the side walls 6 and 7, but for the most part by the counter-wall 9.

In order to produce the largest possible quantity of wood chips of identical quality and a chip thickness lying within a predetermined tolerance range, it is provided according to the invention that the forward feed movement of the knife ring 2 is carried out on a curved path. The path movement, which describes the axis of rotation 3 of the knife ring 2, is indicated by way of example as circular path 11. According to FIG. 4, the circular path 11 extends in the drawing plane, i.e., the axis of rotation 3 is oriented at a right angle to the circular area enclosed by the circular path 11.

The movement of the axis of rotation 3 on the circular path 11 is achieved according to the invention by a rocker 12 which is mounted so as to be tiltable about a swiveling axis 13 and on which the knife ring 2 is rotatably supported. The driving motor 14 which serves to generate the rotating movement of the knife ring 2 and, for this purpose, is connected with the knife ring 2 via a belt drive 15 is likewise arranged on the rocker 12.

In the embodiment example shown in the drawing, the swiveling movement of the knife ring 2 is carried out in the counterclockwise direction, i.e., the inherent weight of the logs 1 acts opposite to the forward feed forces. However, other arrangements are also possible in which the swiveling movement of the knife ring 2 is carried out in the clockwise direction, wherein the knife ring 2 moves approximately in the effective direction of gravitational force toward the logs 1 and the logs 1 must be held against the gravitational force and the forward feed forces caused by the knife ring.

In order to generate the swiveling movement of the rocker 12 about the swiveling axis 13 and accordingly to generate the forward feed movement of the knife ring 2 toward the logs 1, a hydraulic cylinder 16 is provided. The hydraulic system with which the hydraulic cylinder 16 is connected, the driving motor 14 for the knife ring 2, and the driving mechanism for the feeding and holding system are connected with a control device which is not shown in the drawing and which will also not be described since it is already known in the art. Depending on a sequence program in which the above-described movement sequences are stored, the control device initiates and coordinates the individual movements such as introducing the logs 1 into the cutting chamber 10 by controlling the insertion system, switching on the rotation of the knife ring 2 by controlling the driving motor 14, initiating the forward feed movement of the knife ring 2 by application of the hydraulic cylinder 16, reversal of the forward feed movement by application of the hydraulic cylinder 16 in the opposite direction, repeated insertion of the logs 1 into the cutting chamber 10, and so on.

The chips produced during the cutting process fall into the hopper 17 by gravitational force and are transported from the latter for further processing to form OSB.

Based on a preferred construction variant of the invention, the first side wall 6 and the second side wall 7 are constructed so as to be curved in a circular arc shape, wherein the center of curvature of the two side walls and the center of curvature of the circular path 11 lie in the swiveling axis 13. The radius of curvature of the side wall 6 is smaller than the radius of curvature of the circular path 11 and the radius of curvature of the side wall 7 is greater than the radius of curvature of the circular path 11, so that the circular path 11 extends between the two side walls 6 and 7. Due to the curvatures of the side walls 6 and 7 following the circular path 11, the same chip sectors of the knife ring 2 advantageously constantly remain engaged with the logs 1 during the entire cutting process.

Further construction variants lying within the scope of the invention concern the first sidewall 6, the second side wall 7, the base surface 8 and the counter-wall 9. Accordingly, it is possible to construct the latter differently with respect to their dimensions in the direction of the knife ring 2, wherein, for example, the side walls 6 and 7 and the portions of the logs 1 to be cut project into the cutting space 10 and can be arranged so as to be swivelable about the swiveling axis 13 so as to follow the forward feed movement of the knife ring 2, while the counter-wall 9 remains stationary with respect to the frame. While this construction has the advantage that the logs 1 are securely held laterally within the knife ring 2 and in the cutting chamber 10 during the entire cutting process, the relative movement between the side walls 6 and 7 and the counter-wall 9 and the relative movement between the side walls 6 ad 7 and the logs 1 requires that the contact forces by which the logs 1 contact the side walls 6 and 7 are overcome and therefore requires higher forward feed forces.

Similarly, it can be provided that the base surface 8 is arranged so as to project into the cutting space and so as to be movable in conformity with the forward feed movement of the knife ring 2.

Figure 1:
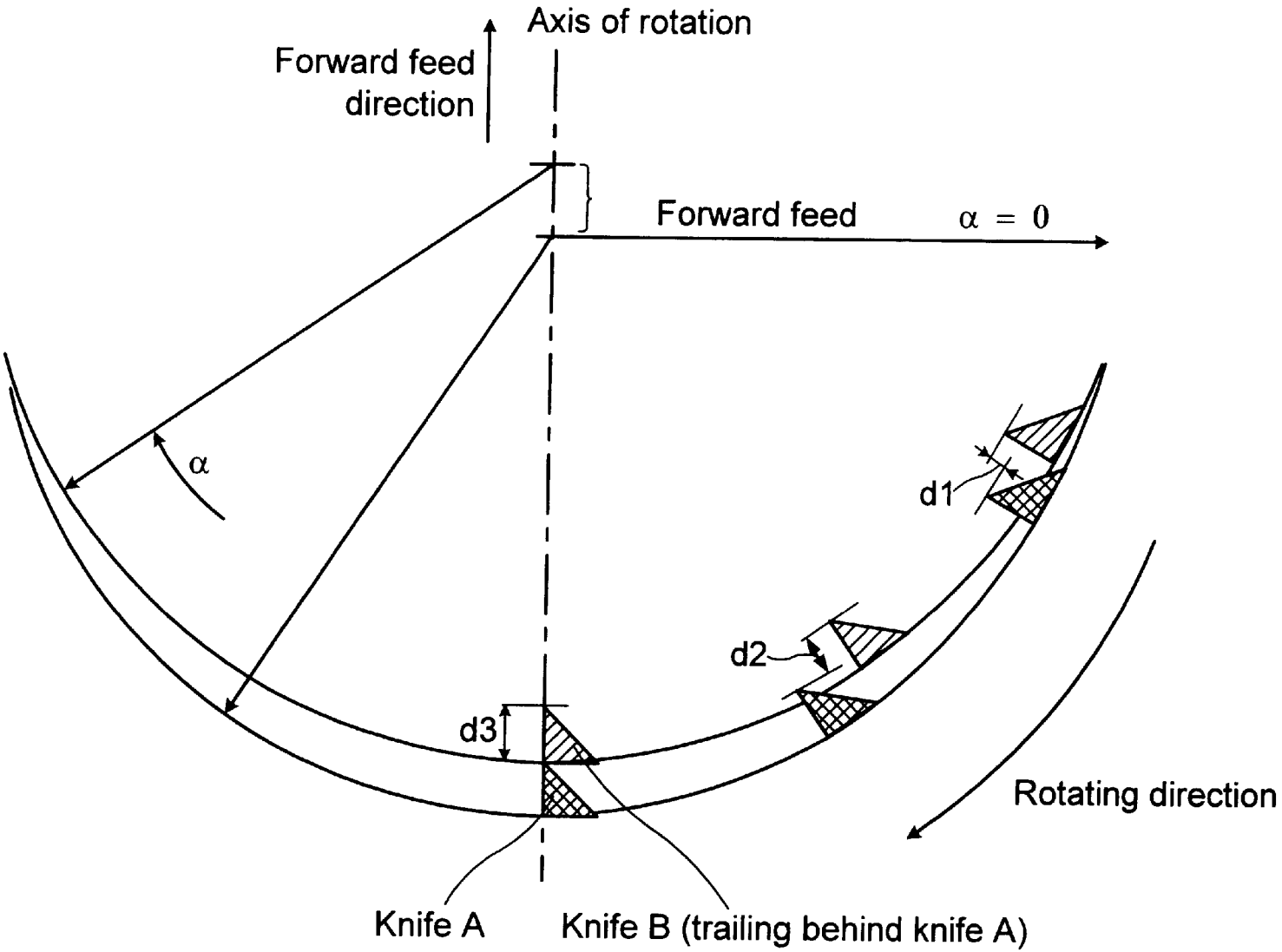
FIG. 1 shows the engagement of the cutters during the rotation of the knife ring.
Figure 2:
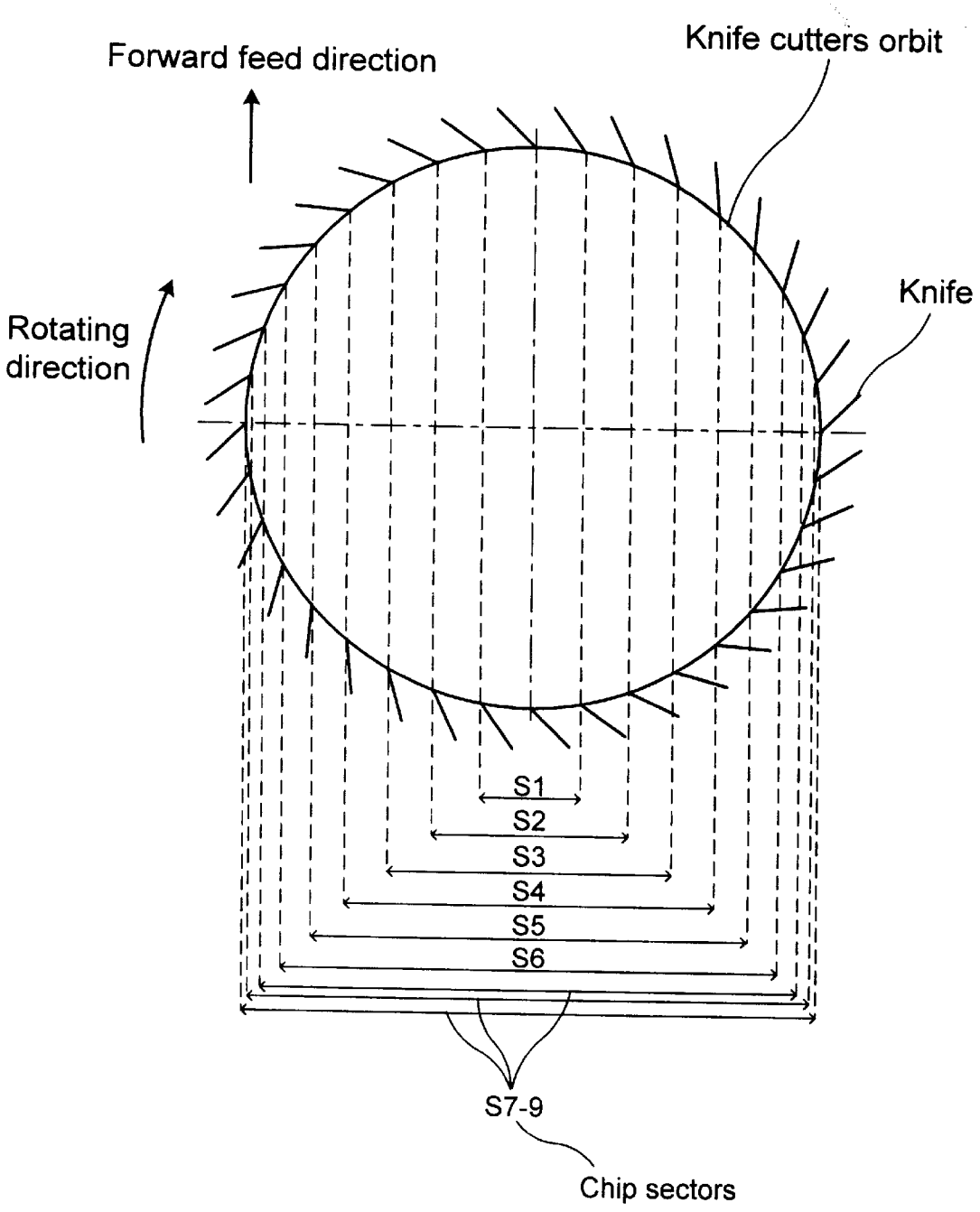
FIG. 2 is an example for dividing the knife ring into chip sectors.
Figure 3:
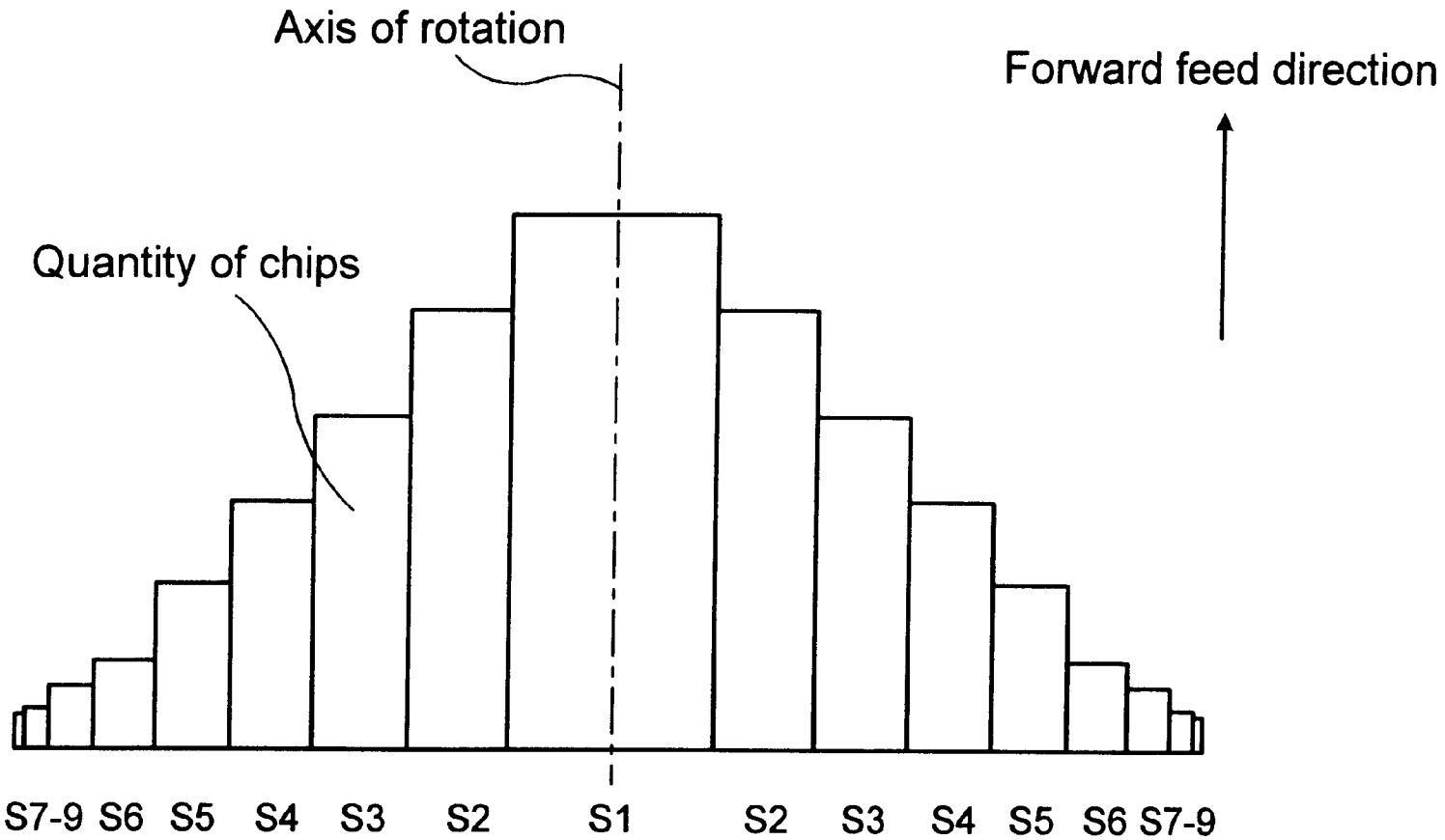
FIG. 3 is an example for distributing the chip thickness over the chip sectors according to the prior art.
Figure 5:
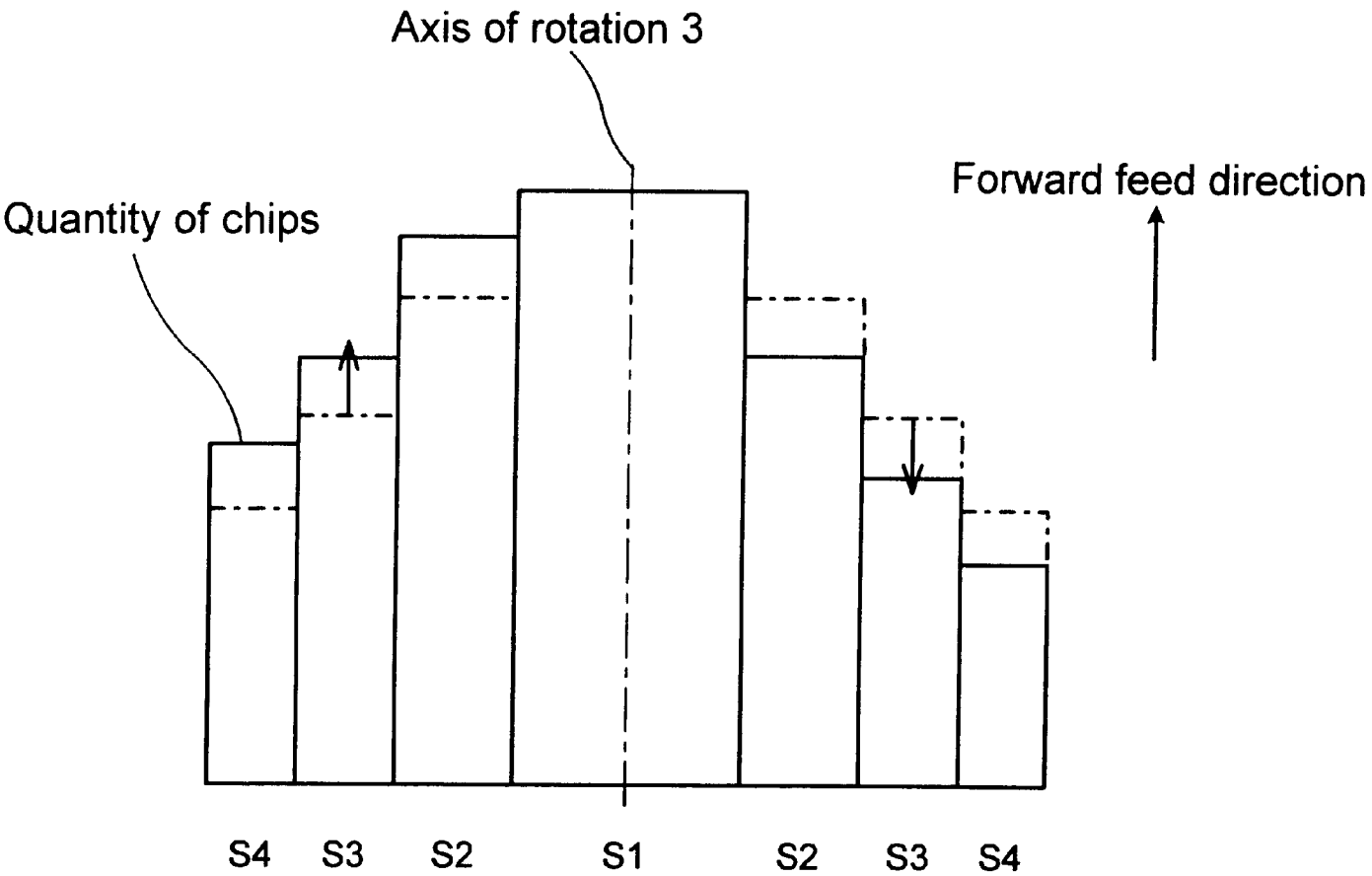
FIG. 5 is a graph showing the distribution of chip thickness over the chip sectors with the use of the process according to the invention.

The change in the chip graph shown in FIG. 5 can be achieved by applying the process according to the invention and the device suggested according to the invention and their variants in the cutting of logs 1. It will be seen from FIG. 5 that the amounts of chips obtained from the individual chip sectors are no longer distributed symmetrically with respect to the axis of rotation 3 as was the case in the prior art (see FIG. 3); rather, there is an asymmetry with respect to the axis of rotation 3, as a result of which a larger quantity of chips are available from the adjacent chip sectors $S_1$, $S_2$ and $S_3$, for example. Therefore, in accordance with the stated object of the invention, a larger quantity of chips of unitary quality is advantageously made available. The width between the side walls 6, 7 and the area between the side walls 6, 7 which receives the logs can be oriented inside the cutting chamber 10 to the sectors which supply chips of sufficient quality and in greater quantities.

In a construction of the device according to the invention which is advantageous in this respect, the distance between the swiveling axis 13 and the axis of rotation 3 is 2,200 mm and the angle β by which the axis of rotation 3 is swivelable is approximately 50°.

In this respect, as is shown in FIG. 4, the connecting straight line between the swiveling axis 13 and the axis of rotation 3 should be oriented approximately horizontally before the start of the cutting process, i.e., during the feeding of the logs 1 into the cutting chamber, and the forward feed movement and swiveling movement of the knife ring 2 about the swiveling axis 13 should be carried out in direction R.

The diameter of the inner circumference 4 of the knife ring 2 outfitted with the cutting knives 5 can advantageously be 2,200 mm, like the distance between the swiveling axis 13 and the axis of rotation 3. The radius of curvature of the first side wall 6 should be 1,550 mm, while the radius of curvature of the second side wall 7 should be 3,050 mm. Therefore, the distance between the circular path 11 on which the axis of rotation 3 moves and the side wall 6 is less than the distance between the circular path 11 and the side wall 7 by 200 mm. As a result of this asymmetry in the positioning of the two side walls with respect to the movement path of the axis of rotation 3, the availability of chips of unitary quality is further improved.

While the foregoing description and drawings represent the preferred embodiments of the present invention, it will be obvious to those skilled in the art that various changes and modifications may be made therein without departing from the true spirit and scope of the present invention.

What is claimed is:

1. A device for cutting logs, comprising:

a rotating knife ring outfitted at its inner circumference with cutting knives oriented parallel to its axis of rotation;

a feeding and holding system for the logs by which the logs are held by one end and introduced into the knife ring by the opposite, free end; and a forward feed device for generating a movement of the rotating knife ring directed to the free ends of the logs;

said forward feed device having a part which is swivelable on a circular path and wherein the rotating knife ring is arranged on this part; and said swiveling axis associated with the part and the axis of rotation of the knife ring being oriented parallel to one another;

said feeding and holding system having two side walls where the logs are held between and which have a circular arc-shaped curvature, wherein the center of the curvatures of he two side walls lie in the swiveling axis of the knife ring and the radius of curvature of a first side wall is less than the swiveling radius or the knife ring and the radius of curvature of the second side wall is greater than the swiveling radius of the knife ring;

said side walls being constructed in such a way that they project into the knife ring by portions and are arranged so as to be stationary with respect to the knife ring, wherein they are movable relative to the logs in conformity to the movement of the knife ring;

and said side walls being arranged in such a way that the distance between the axis of rotation of the knife ring and the second side wall is greater than the distance between the axis rotation of the knife ling and the first side wall.

2. The device according to claim 1, wherein the radius of curvature of the first side wall is approximately 1550 mm, the swiveling radius of the knife ring is approximately 2200 mm, the radius of curvature of the second side wall is approximately 3050 mm, the inner diameter of the knife ring is approximately 2200 mm.

* * * * *